US008919735B2

(12) United States Patent
Rosenboom et al.

(10) Patent No.: US 8,919,735 B2
(45) Date of Patent: Dec. 30, 2014

(54) SCISSOR STACK ASSEMBLY

(75) Inventors: Darin Michael Rosenboom, Orange City, IA (US); Dean Earl Reinking, Kingsley, IA (US); Daniel Jon Van Regenmorter, Sheldon, IA (US)

(73) Assignee: Rosenboom Machine & Tool, Inc., Sheldon, IA (US)

( * ) Notice: Subject to any disclaimer, the term of this patent is extended or adjusted under 35 U.S.C. 154(b) by 765 days.

(21) Appl. No.: 13/034,178

(22) Filed: Feb. 24, 2011

(65) Prior Publication Data

US 2012/0217458 A1 Aug. 30, 2012

(51) Int. Cl.
*E21D 15/44* (2006.01)
*B66F 11/04* (2006.01)

(52) U.S. Cl.
CPC ..... *B66F 11/042* (2013.01)
USPC ..... 254/93 R

(58) Field of Classification Search
USPC ..... 254/122–126, 93 R; 182/69.1
See application file for complete search history.

(56) References Cited

U.S. PATENT DOCUMENTS

| | | | | | |
|---|---|---|---|---|---|
| 3,785,462 | A * | 1/1974 | Coad et al. | ..... | 187/262 |
| 3,961,681 | A * | 6/1976 | Fisher | ..... | 180/305 |
| 4,113,065 | A * | 9/1978 | Sikli | ..... | 187/243 |
| 5,375,681 | A * | 12/1994 | Eickmann | ..... | 187/237 |
| 5,476,050 | A * | 12/1995 | Zimmer et al. | ..... | 108/145 |
| 6,371,247 | B1 * | 4/2002 | Nedderman, Jr. | ..... | 187/211 |
| 7,311,295 | B2 * | 12/2007 | Ha | ..... | 254/122 |
| 2005/0045427 | A1 * | 3/2005 | Rennetaud et al. | ..... | 187/269 |
| 2008/0224107 | A1 * | 9/2008 | Polins et al. | ..... | 254/45 |
| 2010/0133490 | A1 * | 6/2010 | Devine et al. | ..... | 254/134.3 PA |

* cited by examiner

*Primary Examiner* — Lee D Wilson
*Assistant Examiner* — Nirvana Deonauth
(74) *Attorney, Agent, or Firm* — McKee, Voorhees & Sease

(57) ABSTRACT

A scissor-stacked assembly and a method of routing a cable thereto is provided. The assembly includes a plurality of inner arms and outer arms that are connected to one another by retaining pins. The retaining pins are located at central portions of the inner and outer arms and retained by a cap and retaining means. The arms create a plurality of pantographs that allow the assembly to move between a collapsed position and a raised position. Also included is a method of routing a cable through the assembly. The method includes the use of wire forms or tie bars to affix a cable or hose to the wire form or tie bar. The hose is wrapped around crosstubes connecting right and left side arms of the assembly and is attached to the wire forms or tie bars by the use of zip ties or hose clamps.

34 Claims, 15 Drawing Sheets

SCISSOR STACK ASSEMBLY

FIELD OF THE INVENTION

The present invention relates generally to the field of scissor lifts. More particularly, but not exclusively, the present invention relates to an improved scissor stack assembly having fewer parts to lessen the cost, while retaining the structural strength of the assembly. The invention also relates to an improved method of routing a hose or cable from a lower end of a scissor stack to an upper end of the assembly.

BACKGROUND OF THE INVENTION

Scissor stack assemblies, more commonly known as scissor lifts, are well known and used in many fields. A scissor lift is a type of platform which can usually only move vertically. Public institutions, ports, bridge maintenance, electrical companies, warehouses, arbor care, and construction are just a few of the industries that utilize scissor lifts. The lifts provide temporary access for people or equipment to inaccessible areas, usually at a height. The mechanism to achieve this is the use of linked, folding supports or arms in a criss-cross 'X' pattern, known as a pantograph. The upward motion is achieved by the application of pressure to the outside of the lowest set of supports, elongating the crossing pattern, and propelling the work platform vertically. The platform may also have an extending 'bridge' to allow closer access to the work area (because of the inherent limits of vertical only movement).

The contraction of the scissor action can be hydraulic, pneumatic or mechanical (via a leadscrew or rack and pinion system). Depending on the power system employed on the lift, it may require no power to enter 'descent' mode, but rather a simple release of hydraulic or pneumatic pressure. This is the main reason that these methods of powering the lifts are preferred, as it allows a fail-safe option of returning the platform to the ground by release of a manual valve.

The lifts generally include outer and inner supports that form the pantographs. Generally, the outer and inner support members are made of rectangular shaped steel tubes, and include a number of apertures or through holes through both walls of the tubes. Bosses are typically inserted through adjacent holes of the outer and inner members, and pins are inserted through them. Constructing the scissor lifts in this manner involves a large amount of time, as well as a large amount of materials. It can be time and material consuming to insert a boss and pin through each set of holes of aligning inner and outer support members of the pantographs. After the bosses and pins have been inserted, a manufacturer must ensure that all of the pins inserted through the members have been retained by bolts or other retaining and/or securing means, which further increases the time and amount of materials required. Additionally, connecting the members with bosses and pins retained at both the outer and inner members decreases the rigidity of the members as both the outer and inner members include bearing joints, which increase movement (known as "play") between the members, decreasing the structural strength of the lifts. The play, or movement, is caused by the number of moving parts of the assembly. Most lifts include tubes with at least three holes for inserting bosses and members. Therefore, each tube will have at least three locations with parts moving in relation to one another.

Another issue with inserting pins through multiple holes in each of the inner and outer members involves treating the pins to avoid corrosion. When the pins are inserted through the members, their ends and possibly a portion of the pin bodies are exposed. As the pins are often made from steel, or a steel bar, the exposed portions and ends may rust or corrode in normal elements. Therefore, the ends and exposed portions must be plated or treated in some manner. To ensure the utmost safety in constructing the scissor lift, it is vital that any and all portions or the steel pins be treated to prevent corrosion. The treatment of all of the pins is time and labor consuming, and requires checking at regular intervals to insure that no portion of the pins has started corroding, which could potentially reduce the structural integrity of the scissor lift.

Once the pantographs have been assembled, it is common that a manufacturer or user may need to route cables, wires, and/or hoses from the bottom of the lift to the top. The routing may be accomplished in many ways. One is to route or direct the hose, cable, and/or wire back and forth inside the tubes, looping on each end between the tubes. This method does not result in a very clean look, as portions of the hose, cable, and/or wire remain outside the tubes. A cleaner way to route the cables, hoses, and/or wires from the bottom of the scissor lift to the top is to cap the tube ends and route along the inside of the tubes. This method can become expensive because it takes some apparatus, such as a tray system, to jump from section to section, and there may be a lot of jumps to make depending on the height of the scissor lift.

Therefore, there is a need in the art to provide a scissor stack assembly that can be manufactured using fewer parts to increase the rigidity of the assembly. There is also a need in the art to provide an assembly that provides for fewer moving components during use of the assembly. Additionally, there is a need in the art for an improved method of routing a hose, cable, and/or wire from the bottom portion of a lift assembly to an upper portion of a lift assembly that is clean looking, inexpensive, and efficient.

It is therefore a primary object, feature, and/or advantage of the present invention to overcome or improve on the deficiencies in the art.

It is another object, feature, and/or advantage of the present invention to provide an improved scissor stack assembly that includes fewer moving parts during operation to increase the rigidity of the assembly.

It is another object, feature, and/or advantage of the present invention to provide an improved scissor stack assembly that reduces the number of parts required to assemble the scissor stack.

It is another object, feature, and/or advantage of the present invention to provide an improved scissor stack assembly that includes the use of a preplated steel bar to make pins that are corrosion-resistant.

It is another object, feature, and/or advantage of the present invention to provide an improved scissor stack assembly that covers non-plated ends of pins to prevent corrosion of the non-plated portions or ends of the pins.

It is another object, feature, and/or advantage of the present invention to provide an improved scissor stack assembly that retains outer support members to inner support members only by a cap covering a pin extending from the outer member through the inner member.

It is another object, feature, and/or advantage of the present invention to provide an improved scissor stack assembly that includes welding pins to outer members to extend from the outer members through the inner members.

It is yet another object, feature, and/or advantage of the present invention to provide a method of routing a cable, hose, and/or wire from the bottom or lower portion of a scissor stack assembly to an upper location of the scissor stack assembly.

It is still another object, feature, and/or advantage of the present invention to provide a method of routing a cable, hose, and/or wire from a lower portion to an upper portion of a scissor stack assembly using wire forms and tie cables positioned alongside the tubes of the assembly.

These and/or other objects, features, and advantages of the present invention will be apparent to those skilled in the art. The present invention is not to be limited to or by these objects, features and advantages. No single embodiment need provide each and every object, feature, or advantage.

SUMMARY OF THE INVENTION

According to one aspect of the present invention, a scissor stack assembly is provided. The assembly includes a plurality of inner and outer arms operably connected to each other so as to move the assembly between a collapsed position and a raised position. The outer arms are connected to the inner arms by a retaining pin extending inward from a central position of the outer arm along its length through an aperture in a central position of the inner arm along its length and retained with a cap covering a portion of the retaining pin extending through the inner arm.

According to another aspect of the present invention, a scissor stack assembly for raising a load between a collapsed position and a raised position is provided. The assembly includes a right bottom arm comprising a tube with connecting pins extending inwardly proximate opposite ends of tube, and a retaining pin extending inward at a central location along the length of the tube, and a left bottom arm comprising a tube with connecting pins extending inwardly proximate opposite ends of tube, and a retaining pin extending inward at a central location along the length of the tube. A first cylinder arm is positioned between the right and left bottom arms, with the first cylinder arm connected to the right and left bottom arms at the retaining pins of the arms. A plurality of right inner and outer arms are operably connected to the right bottom arm, with the plurality of right inner and outer arms retained to each other at retaining pins extending from a central location along the length of each of the outer arms and through an aperture at a central location of each of the inner arms. A plurality of left inner and outer arms are operably connected to the left bottom arm, with the plurality of left inner and outer arms retained to each other at retaining pins extending from a central location along the length of each of the outer arms and through an aperture at a central location of each of the inner arms. A second cylinder arm is operably connected between the plurality of right inner and outer arms and the plurality of left inner and outer arms, and a cylinder is positioned between the first and second cylinder arms.

According to still another aspect of the present invention, a method of routing a cable or hose from a lower end of a scissor stacking assembly to an upper end of the assembly is provided. The method involves providing a scissor stack assembly including a plurality of inner and outer arms connected to one another, a retainer pin extending from the outer arms through an aperture in the inner arms to retain the arms together, and a plurality of crosstubes extending from a right side of the assembly to a left side. A plurality of wire forms from one of the plurality of crosstubes are connected to one of the plurality of retaining pins along an inside of an outer or inner arm from the lower end of the assembly to the upper end of the assembly. A cable or hose is attached to the plurality of wire forms from the lower end of the assembly to the upper end of the assembly.

According to yet another aspect of the present invention, a scissor stack assembly is provided. The assembly includes a right side comprising a plurality of outer arms including connecting pins extending from opposite ends or the arms and a retaining pin extending from a central location along the length of the arm, and a plurality of inner arms connected to the outer arms, the inner arms including connecting apertures at opposite ends of the arms and a retaining aperture at a central location along the length of the arm. The retaining pins are configured to be inserted through the retaining apertures and the connecting pins are configured to be inserted through the connecting apertures. The assembly further includes a left side comprising a plurality of outer arms including connecting pins extending from opposite ends or the arms and a retaining pin extending from a central location along the length of the arm, and a plurality of inner arms connected to the outer arms, the inner arms including connecting apertures at opposite ends of the arms and a retaining aperture at a central location along the length of the arm. The retaining pins are configured to be inserted through the retaining apertures and the connecting pins are configured to be inserted through the connecting apertures. A plurality of retaining caps cover a portion of the retaining pins to hold the inner and outer members together. A plurality of crosstubes extend from the plurality of connecting pins of the right side to the plurality of connecting pins on the left side. Finally, a cylinder is operably connected to the right and left sides to extend and retract the assembly between a collapsed position and a raised position.

DETAILED DESCRIPTION OF THE PREFERRED EMBODIMENTS

Figure 1:
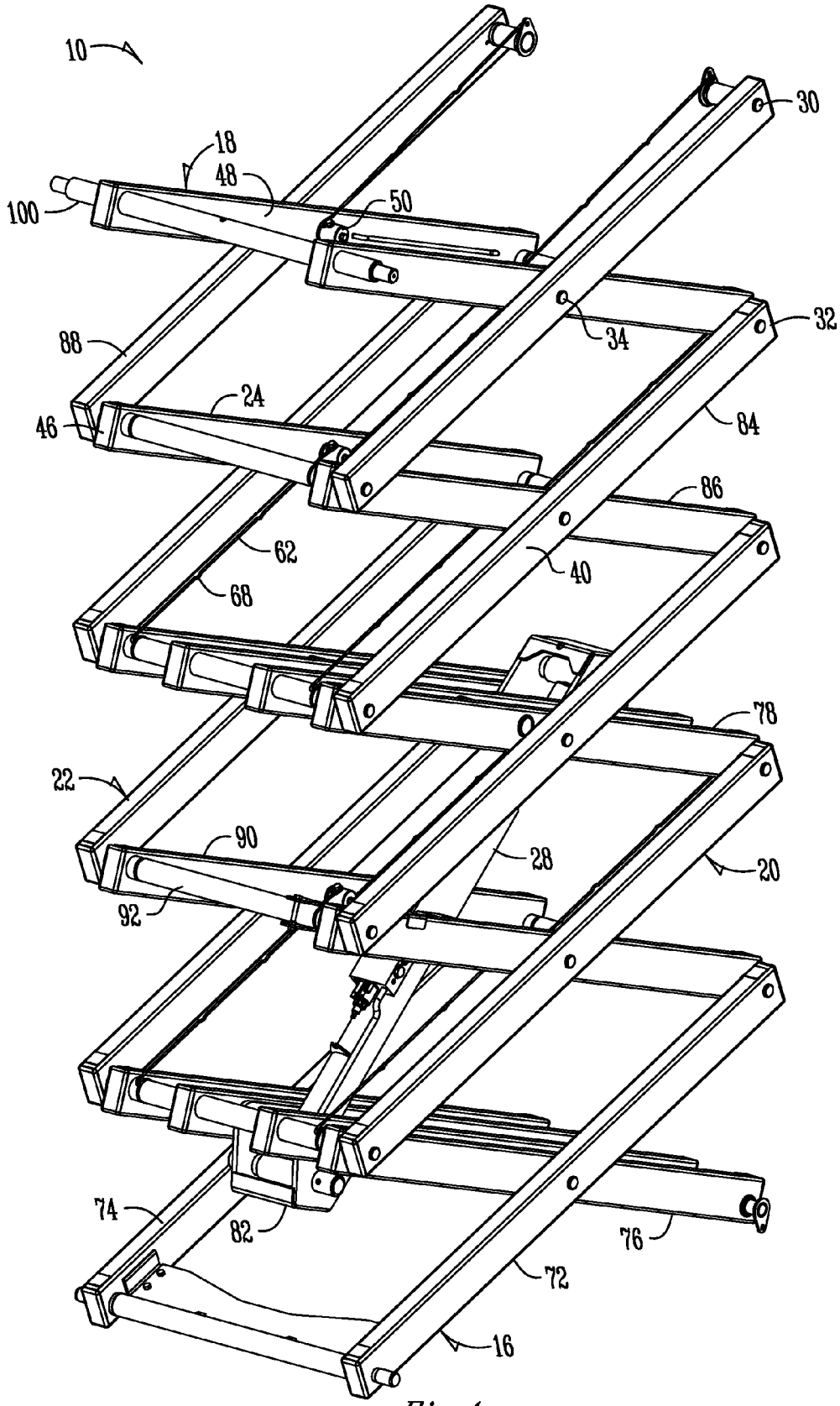
FIG. 1 is a perspective view of an embodiment of a scissor stack assembly according to the present invention.

FIGS. 1-6 depict an embodiment of a scissor stack assembly 10 according to the present invention. The assembly 10 includes a right side 20 and a left side 22 of pantographs, which are folding supports or arms in a criss-cross or X pattern. This is known in the art to be able to lift or move a scissor lift from a collapsed position 12 to a raised position 14. The pantographs of the right side 20 and left side 22 of the assembly 10 comprise outer arms 26 and inner arms 24 connected together. As shown in the FIGS. 1-6 and 8-11, the outer arms 26 include a plurality of pins including connecting pins 30 located at the ends 32 of the outer arms 26, and a retaining pin 34 located at a center or central region 40 of the outer arms 26. As will be discussed below, the connecting pins 30 and retaining pin 34 extend inwardly from the outer arms 26 and are affixed, such as by welding, to the outer arms 26. The fixing of the pins to the outer arms 26 increases the rigidity of the assembly 10 such that it reduces the amount of moving parts in relation to one another.

Starting at a lower end 16 of the assembly 10 are a right bottom arm 72 and a left bottom arm 74. The bottom arms 72, 74 each include two connecting pins 30 extending inward at the ends 32 of the arms and retaining pins 34 extending from a center 40 of the arms. Positioned between the right bottom arm 72 and left bottom arm 74 is a first cylinder arm 76. The first cylinder arm 76 comprises a plurality of inner tubes 80 and a support member 82. Connecting the plurality of inner tubes 80 is a crosstube 92 extending through apertures of the inner tubes 80. Operably connected to the right and left bottom arms 72, 74 and the first cylinder arm 76 are a plurality of outer arms 26 and inner arms 24 extending upwards to an upper end 18 of the assembly 10. The inner arms 24 and the outer arms 26 may generally comprise right outer arms 84, right inner arms 86, left outer arms 88, and left inner arms 90. While the assembly 10 includes both right and left arms, it should be appreciated that the arms are generally mirror images of one another when referenced as right and left sides. The depiction of right or left arms is merely used to help illustrate the figures as shown.

Located on the right side 20 of the assembly 10 are a plurality of right outer arms 84 and right inner arms 86. The right outer arms 84 include connecting pins 30 at each of the ends 32 of the arms extending generally inward from the outer arms 84. The connecting pins 30 are affixed to the right outer arms 84, such as by welding the pins at the outer arms. Located at a central region 40 of the right outer arms 84 and extending inwardly is a retaining pin 34. The retaining pin 34 is also affixed, such as, by welding the pin to the right outer arm 84. The right outer arms 84 are connected to the right inner arms 86 by extending the connecting pins 30 and retaining pins 34 through apertures of the inner arms 86. Located in the central region 48 of the right inner arms 86 is a retaining aperture 42 for receiving the retaining pin 34 extending from the right outer arms 86. Likewise, the ends 46 of the right inner arms 86 include connecting apertures 44 for receiving the connecting pins 30 of a separate right outer arm 84. It should be noted that only the retaining pin 34 is fixed, or retained, and connected to the inner arm 86. The retaining pin 34 is retained by a cap 50 being placed over a portion 36 of the retaining pin 34 that extends through and beyond the inner arm. A portion of the connecting pin that extends beyond the inner arm at the end 46 of the inner arm is inserted into a recess 94 of a crosstube 92. The crosstubes 92 extend between right inner arms 86 and left inner arms 90. The crosstubes 92 works generally to connect the right side 20 and left side 22 of the assembly 10.

Figure 2:
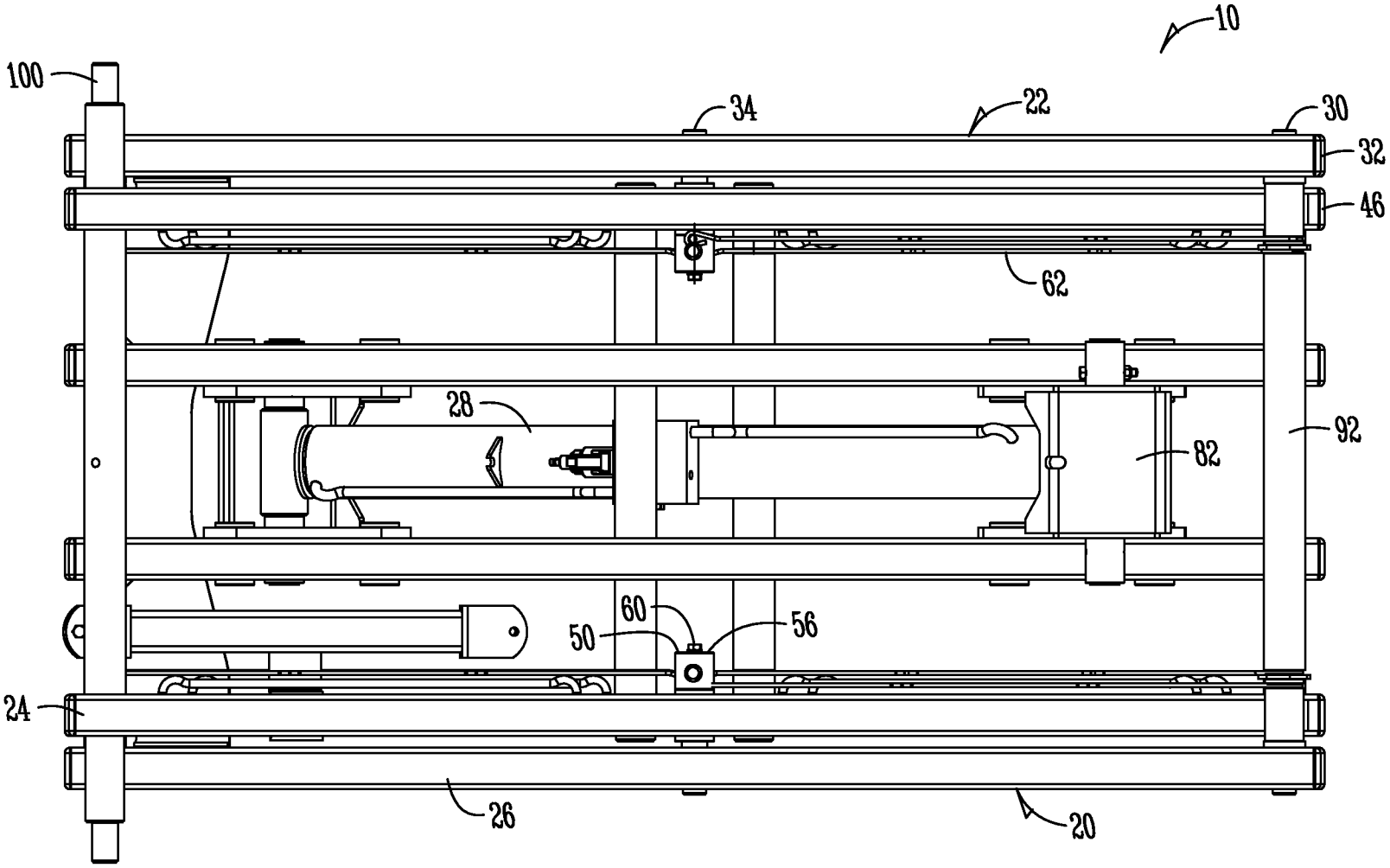
FIG. 2 is a top view of a collapsed scissor stack assembly according to the present invention.
Figure 3:
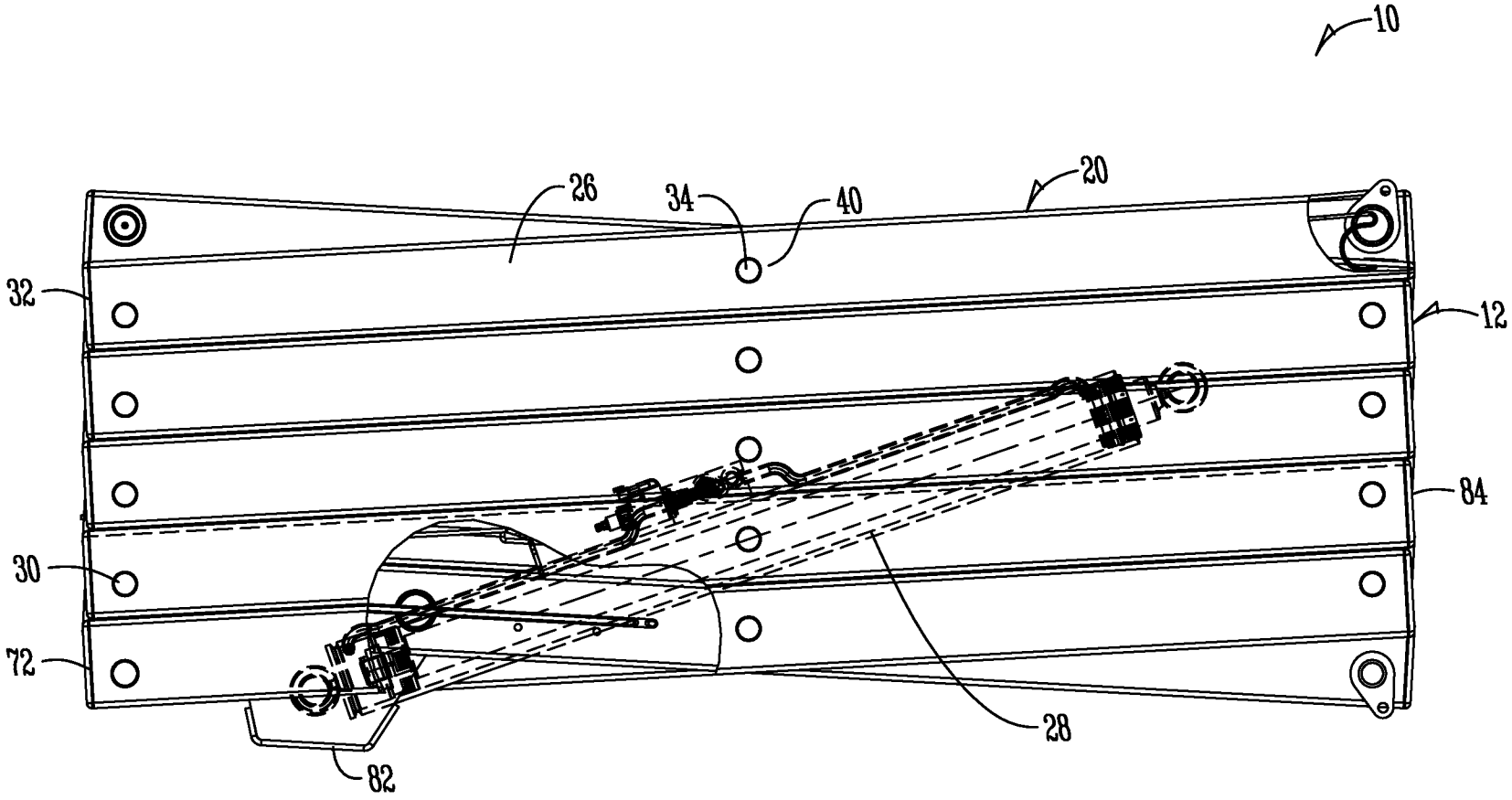
FIG. 3 is a side view of the scissor stack assembly of FIG. 2 in a lower or collapsed position showing the right side.
Figure 4:
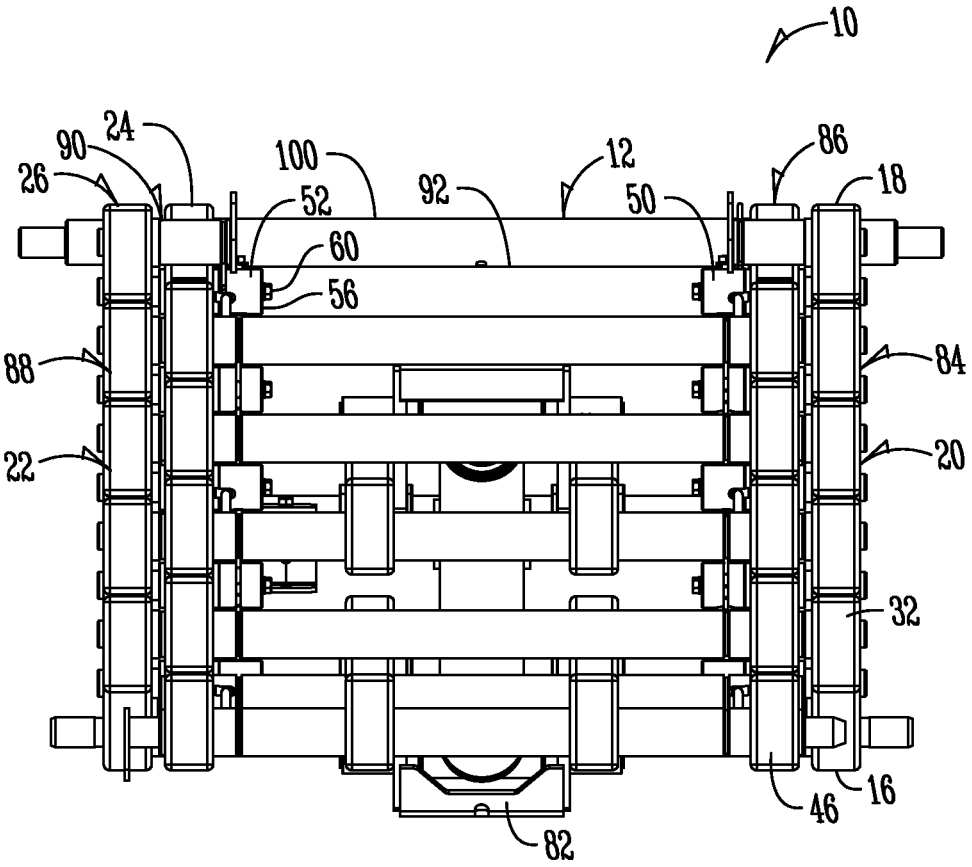
FIG. 4 is a front view of the collapsed scissor stack assembly of FIG. 2.
Figure 5:
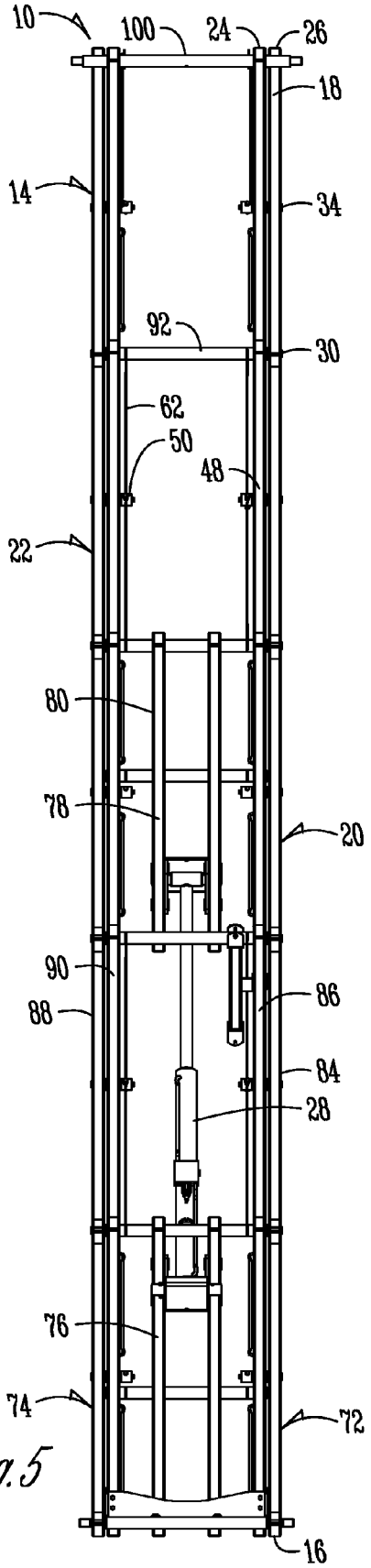
FIG. 5 is a front view of the scissor stack assembly of FIG. 2 in a raised or extended position.
Figure 6:
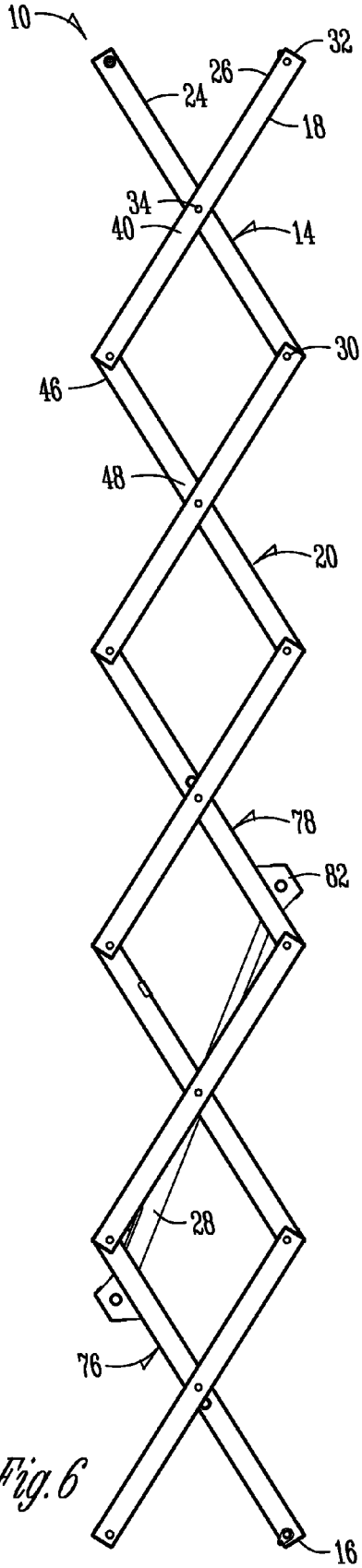
FIG. 6 is a right side view of the scissor stack assembly of FIG. 2 in a raised position.

Additionally shown in the figures is a second cylinder arm 78 positioned away from the first cylinder arm 76. The second cylinder arm comprises the same components as the first cylinder arm in a generally opposite orientation. Between the first and second cylinder arms 76, 78 and operably connected thereto, is a cylinder 28. The lift cylinder is used to move the assembly 10 between a collapsed position 12 as is shown in FIGS. 2, 3 and 4 and a raised position 14 as is shown in FIGS. 5 and 6. As is understood in the art, as the cylinder 28 extends its cylinder arm 29, the inner arms 24 and outer arms 26 will rotate in relation to one another to extend the upper end 18 away from or descend the end towards the lower end 16. The size of the cylinder may be selected as desired to be able to extend and retract an assembly 10 between a raised position 14 and collapsed position 12.

Figure 7A:
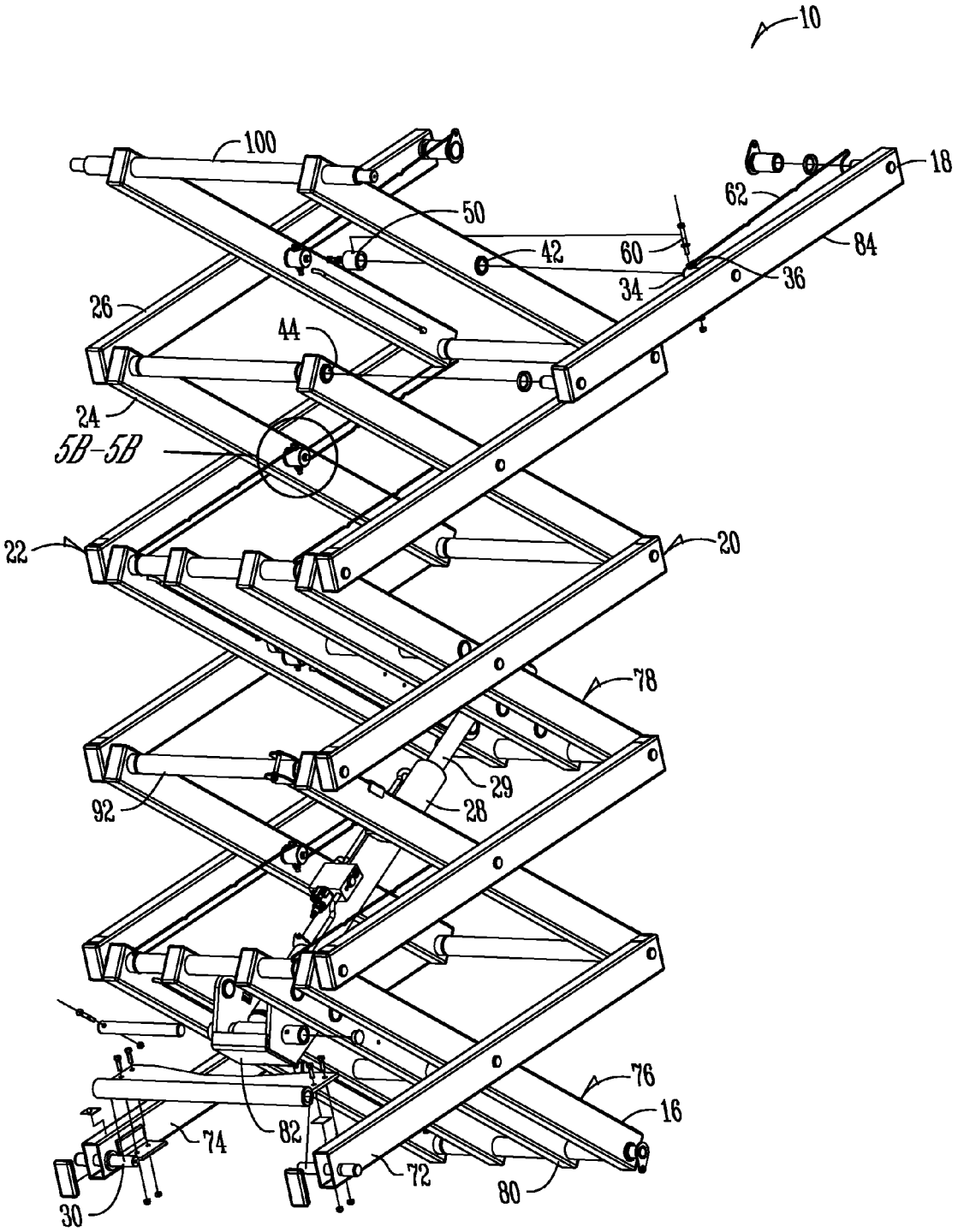
FIG. 7A is a partially exploded view of a scissor stack assembly according to the present invention.
Figure 7B:
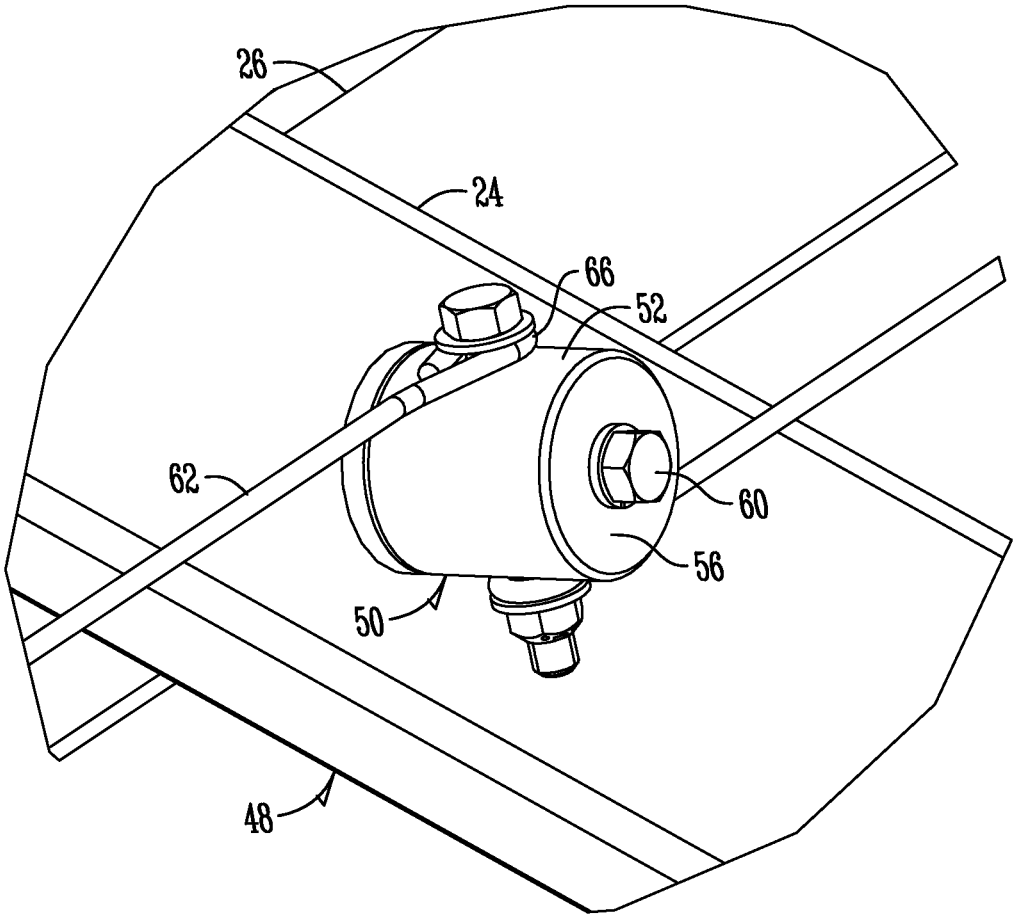
FIG. 7B is an enlarged view of a portion of FIG. 7A according to 7B-7B.

FIG. 7A is a partially exploded view of the scissor stack assembly 10 in an at least partially raised or extended position 14 according to the present invention. FIG. 7A shows an upper end 18 of the assembly where a right outer arm 84 is exploded away from a right inner arm 86. As shown in FIG. 7A, the right outer arm 84 has connecting members 30 at the ends 32 of the arm. The connecting pins 30 extend inwardly to be inserted through connecting apertures 44 at the ends 46 of separate right inner arms 86. The connecting pins 30 further are inserted into recesses 94 at the ends of crosstubes 92 positioned between right inner arms 86 and left inner arms 90. The recesses 94 of the crosstubes 92 allow the connecting pins 30 to rotate within the crosstubes 92 so as to move the assembly 10 from a collapsed position 12 to a raised position 14. As discussed above, the retaining pin 34 of the right outer arm 84 is inserted through a retaining aperture 42 of the right inner arm 86. As the retaining pin 34 is longer than the width of the right inner arm 86, a portion 36 will extend therethrough. Through this portion 36 is at least one retaining pin aperture 38. A cap 50 including a cap body 52 with an aperture 54 therethrough is positioned over the retaining pin 34 so that the pin is inserted into a recess 55 of the cap 50. The cap body aperture 54 and the retaining pin aperture 38 are aligned and a cap securing means 60 is inserted therethrough to retain the right outer arm 84 in connection with the right inner arm 86. The securing means 60 may be a bolt, a clevis pin, or any other type of pin or securing member which is known and used in the art. As shown in FIG. 7A, the securing means 60 is a bolt that is inserted through the cap 50 and retaining pin 34 with a nut being screwed on the opposite side to hold the cap 50 in place over the retaining pin 34. The retaining pin 34 may also have an aperture through the end of the pin with the cap end 56 also having an aperture 58 therethrough to receive another means for securing 60. Although the additional aperture and securing means are not necessary, the redundancy may provide greater safety features. FIG. 7B shows the cap 50 and securing means 60 in greater detail.

Also shown in FIGS. 7A and 7B are a plurality of wire forms 62 and tie bars 102. The wire forms 62 are formed pieces of wire which extend between a crosstube 92 and a cap 50. The wire forms 62 include tie areas 66 and aid in routing a hose, cable, or wire from a lower end 16 of the assembly 10 to an upper end 18 of the assembly 10. The wire forms 62 may be attached and detached from assembly 10 quickly as needed. The tie bars 102 are pieces of steel with generally curved shaped ends 104 that are welded or otherwise affixed to the side of inner arms 24. The tie bars 102 also aid in the routing of cables, hoses, and/or wires from the lower end 16 to the upper end 18 of the assembly 10. A method of routing cables will be discussed in greater detail below.

Figure 8:
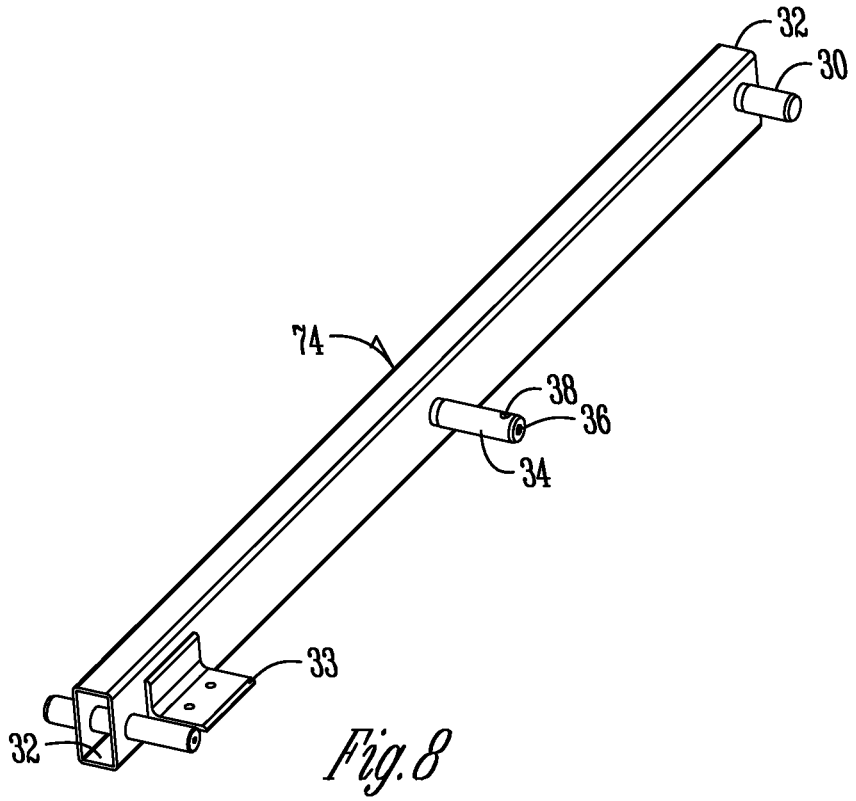
FIG. 8 is a left bottom arm member of an embodiment of a scissor stack assembly according to the present invention.
Figure 9:
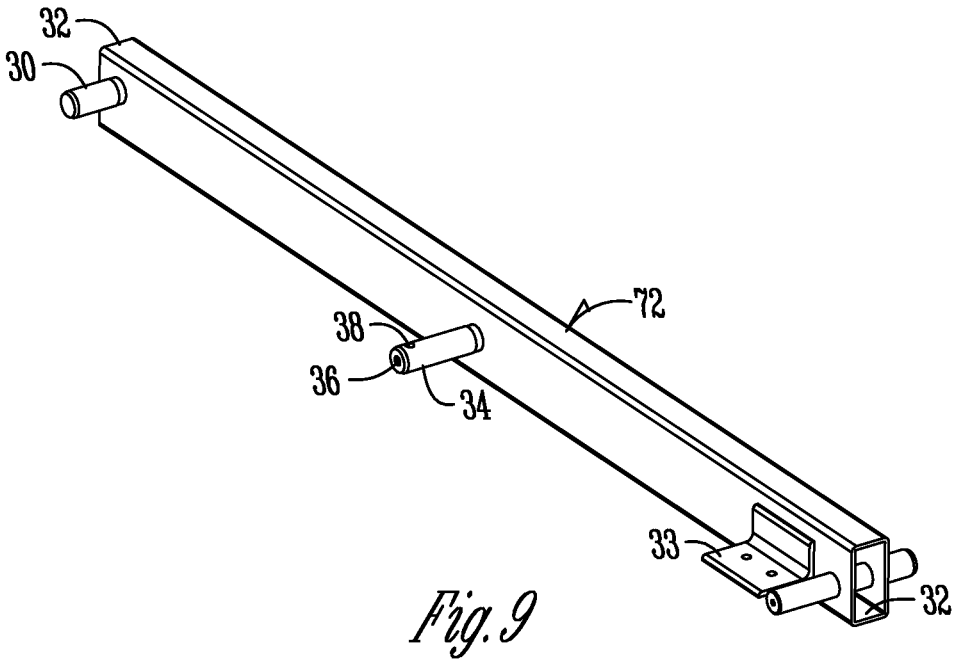
FIG. 9 is a right bottom arm member of an embodiment of a scissor stack assembly according to the present invention.

FIGS. 8 and 9 show left and right bottom arms of the assembly 10. As discussed above, the right bottom arm 72 and the left bottom arm 74 are generally mirror images of one another, and thus may be described in the same manner. The arms comprise a rectangular shaped tube having dimensions of 2 inches by 4 inches and with a wall thickness of 3/16th of an inch and being made from ASTM A500 steel. While this particular sized tube may be preferred, it is appreciated that other sizes and thicknesses may be desirable depending on the requirements and use of the assembly 10. The left bottom arm 74 and right bottom arm 72 also include three apertures through both walls of the tubes. Two apertures are positioned near the ends 32 of the arms, while one is positioned at a center region 40 of the arms. In the outer ends 32 of the arms is inserted connecting pins 30, and the center aperture is positioned to retaining pin 34. The connecting pins 30 may be different lengths. The connecting pins 30 and retaining pin 34 are then affixed to the arms, such as by welding the pins around the base of the pins to the tubes. As is shown in FIGS. 8 and 9, the retaining pin 34 will further include at least one retaining pin aperture 38 through the pin for retaining the arms to inner arms. The right and left bottom arms 72, 74 also included stiffener mounts 33 to provide a place to connect a bottom crosstube that also increases the stability of the assembly 10.

The pins 30, 34 comprise a bar ground, polished and pre-plated with hard chrome. The chrome is a hard chrome plate configured for wear resistance. The bar, starting at usually 24 feet in length, may be cut to the size of the pins. The ends of the pins may then be machined and chamfered, which removes the plating. The ends will either be painted or covered by the crosstubes 92 or caps 50 such that the unplated areas of the pins are not exposed.

Figure 10:
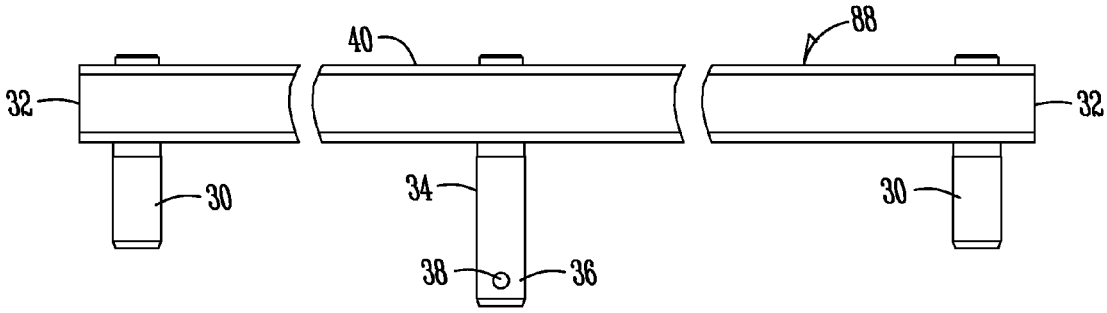
FIG. 10 is a left outer arm of a scissor stack assembly according to an embodiment of the present invention.
Figure 11:
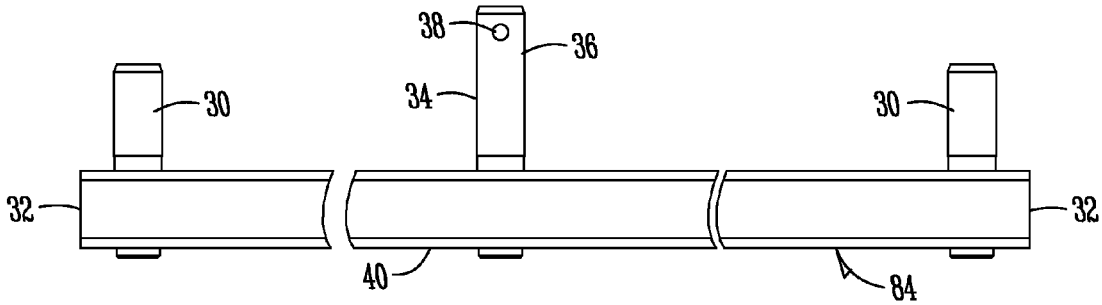
FIG. 11 is a right outer arm of a scissor stack assembly according to an embodiment of the present invention.

FIGS. 10 and 11 show exemplary examples of right outer arms 84 and left outer arms 88. The right and left outer arms 84, 88 are similar in construction to the right and left bottom arms 72, 74. The arms comprise a 2 by 4 rectangular tube having 3/16th inch tubular wall and made from ASTM A500 steel. The outer arms 84, 88 also include connecting pins 30 being affixed and apertures near the ends 32 of the arms, with a retaining pin 34 affixed in an aperture in the center 40 of the arms. The right and left outer arms 84, 88 are generally mirror images of one another such that when positioned with the connecting pins 30 and retaining pins facing one another, the pins will be in alignment. Furthermore, as described with the bottom arms above, the connecting pins 30 and retaining pins 34 may be affixed to the outer arms 84, 88 by means of welding the pins to the rectangular tube of the arms. However, it should be appreciated that other means of fixing the pins in place to the tubes of the arms may be utilized as well. Additionally, the right and left outer arms 84, 88 do not include stiffener mounts.

Figure 12:
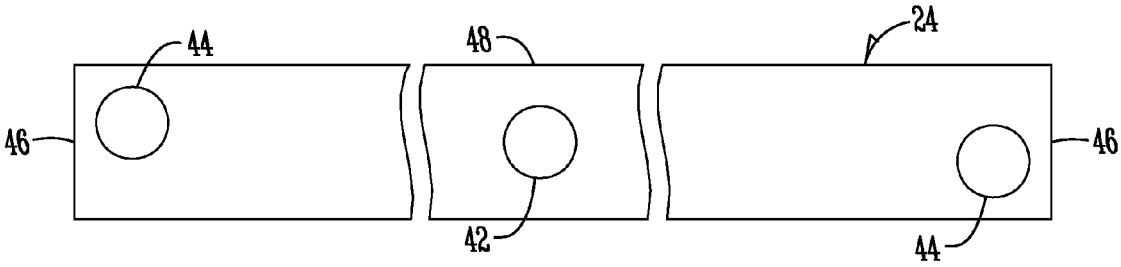
FIG. 12 is an inner arm member of a scissor stack assembly according to an embodiment of the present invention.

FIG. 12 is an exemplary embodiment of an inner arm 24 of the scissor stack assembly 10 of the present invention. It should be appreciated that while the figures are of right inner arms 86 and left inner arms 90, the inner arms 24 themselves are exactly the same with just different orientation. Therefore, the inner arms comprise a 2 by 4 steel rectangular tube having 3/16th inch thick walls and made from ASTM A500 steel. It is further seen that the inner arms 24 include a plurality of apertures therethrough. The apertures include connecting apertures 44 located at the ends 46 of the inner arms 24, and a retaining aperture 42 located at a center or central region 48 of the inner arms 24. The connecting aperture is adapted to line up with the connecting pins 30 of the outer arms 26 in the retaining aperture 42 as adapted to line up with the retaining pin 34 of the outer arms 26. Furthermore, it should be appreciated that a bushing sleeve (not shown) may be welded or otherwise affixed in the retaining aperture 42 to provide for a constant surface from one wall to the other. A right inner arm 86 is connected to a left inner arm 90 by inserting ends 95 of a crosstube 92 through connecting apertures 44 of both arms. The two crosstubes 92 connecting the right and left inner arms are then affixed, such as by welding, to the crosstubes 92 to form an inner arm weldment (not shown). The inner arm weldment decreases the assembly time of the assembly 10.

Figure 13:
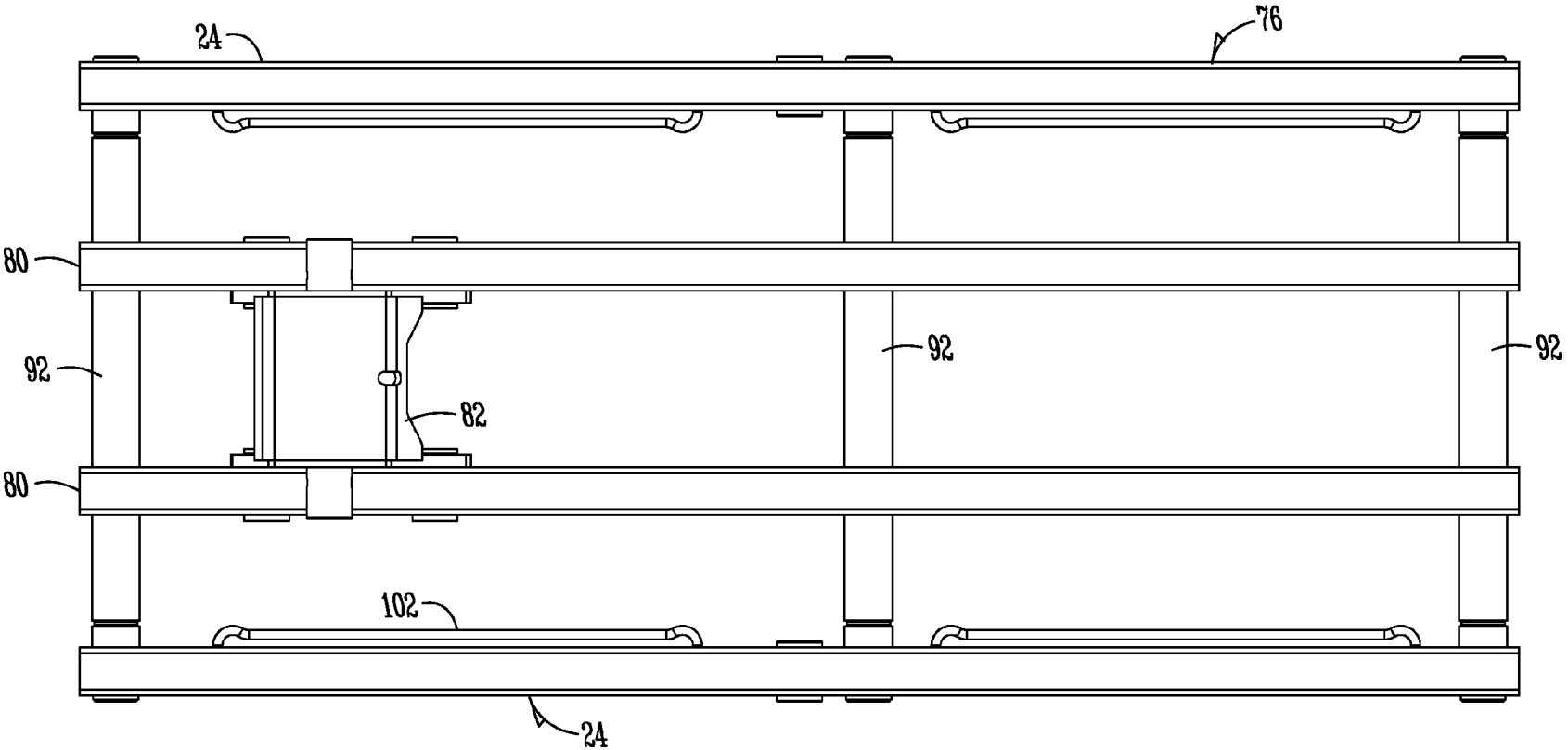
FIG. 13 is a top view of a cylinder arm of a scissor stack assembly according to an embodiment of the present invention.

FIG. 13 is an embodiment of cylinder arms 76, 78 of the present invention. It should be appreciated that the first cylinder arm 76 and second cylinder arm 78 comprise the same design, and are oriented opposite one another to connect to a cylinder 28. Therefore, FIG. 13 will be described in regards to the first cylinder arm 76, with the understanding that the second cylinder arm 78 is designed similarly. The first cylinder arm 76 includes a plurality of tubes connected together. The tubes may be inner arms 24 on the outside, as described in FIG. 12, and inner tubes 80 in the middle. The inner tubes are also 2×4 rectangular tubing having 3/16 inch wall thickness and comprising ASTM A500 steel. FIG. 13 shows that a total of four tubes are used to design the first and second cylinder arms 76, 78 of the present invention. The arms are connected to one another by a plurality of crosstubes 92 inserted through apertures in the tubes 24, 80. The arms 24 are positioned at the outer edges of the crosstubes 92 with the inner tubes 80 being spaced equally apart from the tubes 24 and each other about the crosstubes 92. The tubes may be held in place at the crosstubes 92 by welding the tubes around the apertures in the tubes to the crosstubes 92. The welding or affixing of the tubes to the crosstubes 92 provides greater rigidity and stability in the cylinder arms. Connected between the inner tubes 80 is a support member 82. The support member 82 may be a formed piece of metal or steel configured to receive one end of the cylinder. The support member 82 may also be welded to the inner tubes 80 of the cylinder arm. The support member 82 is made of ¼ inch thick A36 HR plate.

Figure 14:
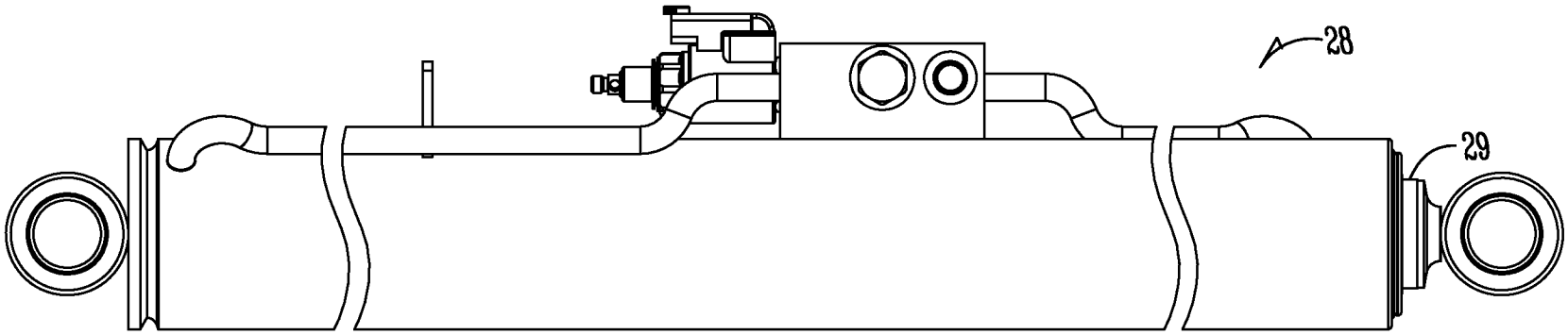
FIG. 14 is a side view of a cylinder of a scissor stack assembly according to an embodiment of the present invention.

FIG. 14 is an example of one embodiment of the cylinder 28 used in the present invention. The cylinder is a standard lift cylinder as is known in the art. Therefore, the cylinder may be a pneumatic cylinder, a hydraulic cylinder, or mechanical. It must be able to raise the weight of the lift assembly 10 from the collapsed position 12 to the raised position 14. In addition, the cylinder arm 29 must be long enough to extend the lift assembly 10 to the fully raised position 14. As was described above, the ends of the cylinder 28 are connected to a support member 82 of a first cylinder arm 76 and a second cylinder arm 78. Therefore, the cylinder arms 76, 78 must be spaced at the appropriate level to ensure that the cylinder 28 will be able to extend to a fully extended position to raise the assembly 10.

Figure 15A:
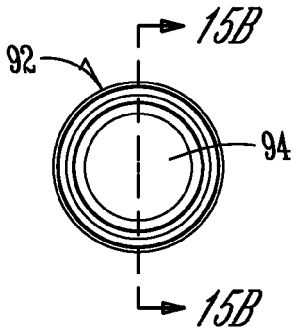
FIG. 15A is an end view of a crosstube according to the present invention.
Figure 15B:
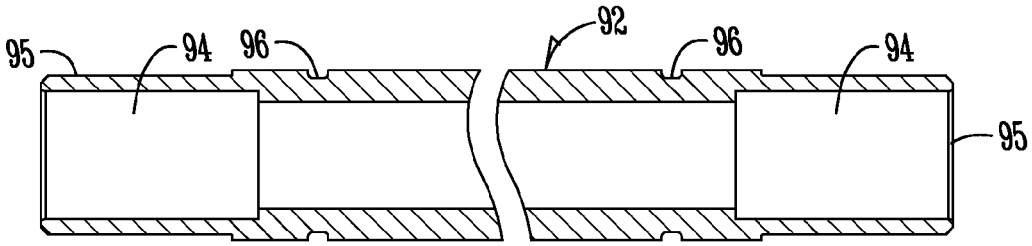
FIG. 15B is a sectional view of the crosstube of FIG. 15A according to 15B-15B.

FIGS. 15A and 15B show an end view and cross-sectional view of a crosstube 92 as may be used in the present invention. The crosstube 92 is a generally tubular shaped member comprising steel, aluminum or any suitable material as is known in the art. In a preferred embodiment, the crosstube 92 is a two (2) inch diameter rod cut to size from 1026 DOM steel. The crosstube 92 includes apertures or recesses 94 on both ends 95 of the tube. The apertures or recesses 94 are sized and configured to receive the connecting pins 30 of the outer arms 26. Therefore, they should be sized both in depth and diameter to receive the connecting pins 30. In addition, the crosstube 92 include grooves 96 positioned near the ends 95 of the crosstube. The grooves 96 may fully surround the crosstube 92 or may only partially surround the crosstube 92. The grooves, as will be discussed in greater detail below, are used to connect the wire form 62 to the assembly 10 to aid in routing a hose or cable 70. Therefore, the number of grooves may vary depending on the use of the assembly 10. However, it should be noted that the grooves 96 will generally be near the ends 95 of the crosstube 92. It should also be noted that the ends 95 of the crosstube 92, including the portion having the recess 94, may have a smaller diameter than the body of the crosstube. This is so that the ends 95 of the crosstube may be inserted through apertures of the inner arms 24. The crosstube is inserted through the aperture and the connecting pins 30 inserted into the recess 94 of the crosstube. Therefore, the pins 30 and ends 95 of the crosstube 92 are fully covered within the tubes or arms during use of the assembly 10 such that the ends of the crosstube and pins do not need to be treated or plated. The non-treatment of the ends of the pins 30 and/or crosstube 92 saves time and money.

Figure 16A:
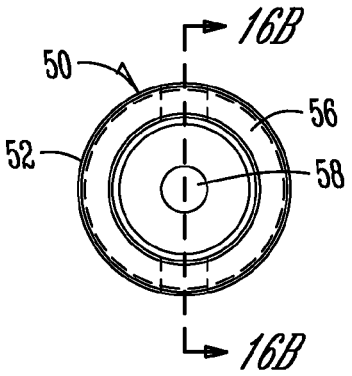
FIG. 16A is an end view of a cap according to the present invention.
Figure 16B:
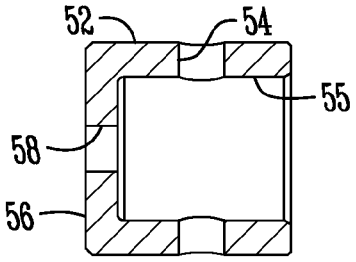
FIG. 16B is a section view of the cap of FIG. 16A according to 16B-16B.

FIGS. 16A and 16B show an end view and cross sectional view of a cap 50 as is used in the present invention. As stated above, the cap 50 is used to cover a portion 36 of the retaining pin 34. The cap 50 is also used to retain the outer arms 26 to the inner arms 24 at the retaining pins 34. As the present invention contemplates only retaining the outer arms 26 to the inner arms 24 at a center retaining pin, only one cap 50 is contemplated as being used per connection of outer arm 26 to inner arm 24. The cap 50 includes a cap body 52, cap body aperture 54, cap recess 55, and cap end 56. As is shown in FIG. 16B, the cap 50 may also include a cap end aperture 58. As is described above, the cap body aperture 54 and cap end aperture 58 may be used to receive securing means 60, such as bolts or pins to secure the cap to the retaining pins 34. Therefore, the cap recess 55 should be designed to have a diameter sufficient to receive a portion or end 36 of a retaining pin 34. The retaining pin aperture 38 is aligned to the cap body aperture 54 such that a pin, bolt, or other securing means 60 may be inserted through both the bap 50 and the retaining pin 34. In order to better secure the outer arms 26 and the inner arms 24 at the retaining pin 34, a second securing means 60 may be inserted through the cap end aperture 58 and into the retaining pin 34. The redundant securing method increases the safety of the assembly 10 by insuring that the outer arms 26 will be secured safely to the inner arms 24 such that the arms will not come apart during use of the assembly 10. While the use of two securing means has been disclosed, however, it should be appreciated that the invention contemplates the use of only one securing means, such as a securing means 60 be inserted through a cap body aperture 54 and retaining pin aperture 38 only. It should also be appreciated that other means of securing the outer arm to the inner arms at the retaining pin 34 are also contemplated.

Figure 17A:
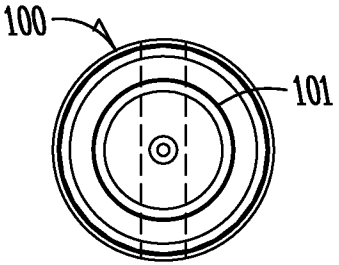
FIG. 17A is an end view of a platform attachment according to the present invention.
Figure 17B:
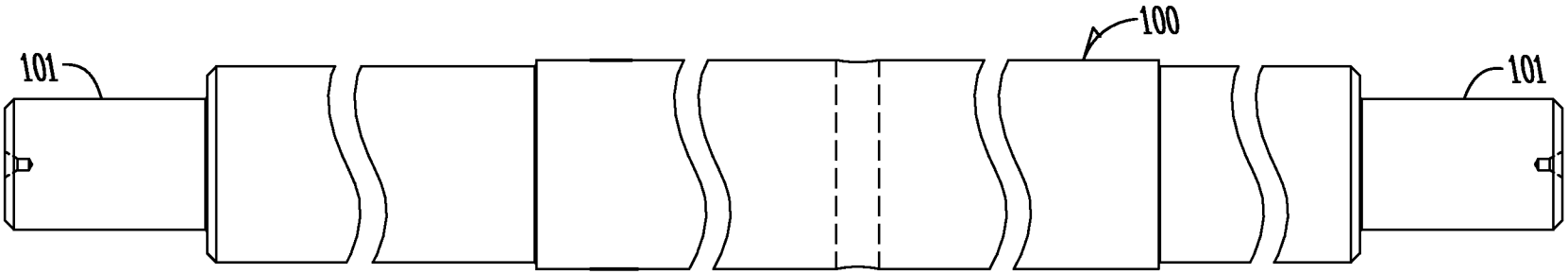
FIG. 17B is a section view of the platform attachment of 17A according to 17B-17B.

FIGS. 17A and 17B disclose a means 100 for attaching to a platform of the other low bearing device (not shown). As shown in FIGS. 17A and 17B, the means 100 is a crosstube including a body and platform extensions 101. The tube or pin 100 is attached at the upper end 18 of the assembly 10. It may be attached to inner or outer arms 24, 26 and sliding blocks that interface with a platform. In use, the extensions would be in communication with a slot or sliding blocks of the platform while the ends of the outer arms 26 of the upper end 18 of the assembly 10 are affixed to the platform. Therefore, when the assembly 10 is moved between a collapsed position and raised position, the pin or tube 100 may slide within the slot or sliding block of the platform, while the outer arms are fixed. This allows the platform to remain level while the assembly 10 is moved between a collapsed position and a raised position.

Figure 18:
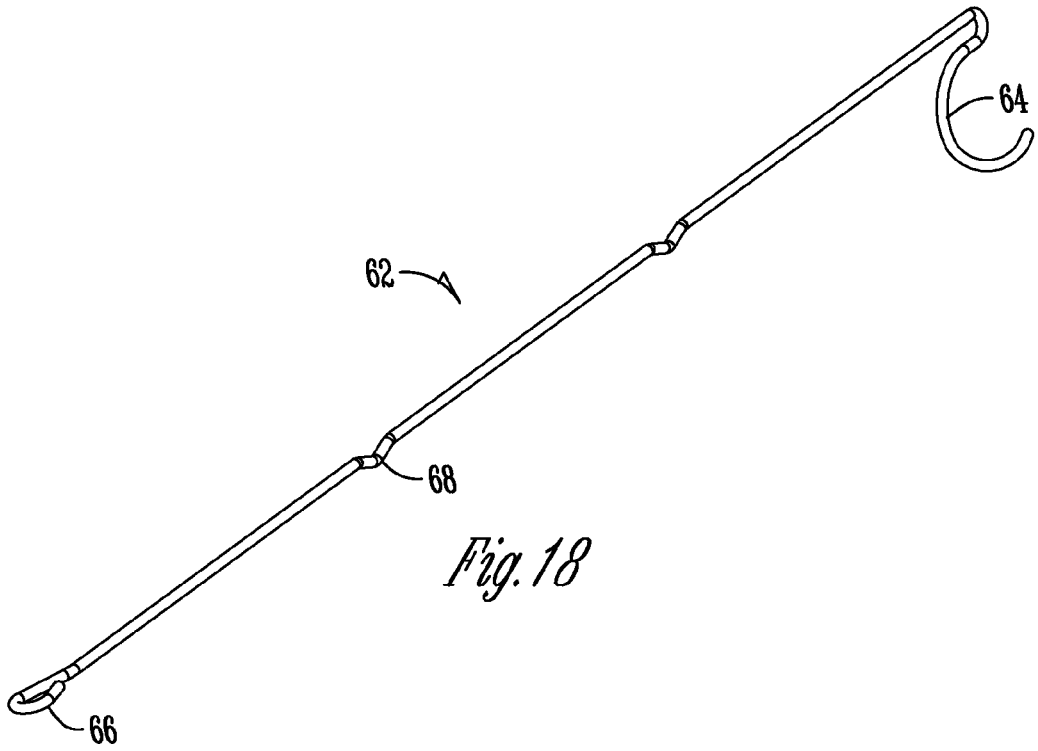
FIG. 18 is a perspective view of a wire form for routing a hose or cable along the arms of a scissor stack assembly.
Figure 19:
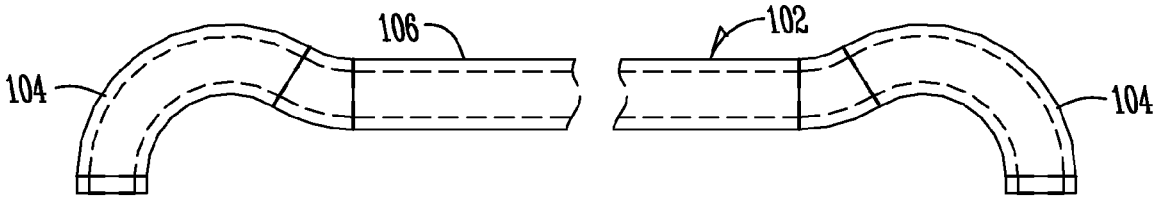
FIG. 19 is a front view of a side bar for routing a hose or cable along a scissor stack assembly.

FIGS. 18 and 19 show components used in routing a hose or cable 70 from a lower end 16 of the assembly 10 to an upper end 18 of the assembly 10. FIG. 18 shows a wire form 62. The wire form 62 comprises a formed metal wire, which may be 3/16 inch diameter music wire. However, it should be noted that the wire may also be comprised of a plastic or any other rigid device. The wire form 62 includes a hook portion 64, a loop portion 66, and a plurality of tie areas 68 therebetween. In use, the hook portion is snap fit around a groove 96 of the crosstubes 92. The loop portion 66 is used in combination with the securing means 60 of the cap 50. The loop portion may be placed adjacent the cap body aperture 54 and secured to the cap 50 by the cap securing means 60. The wire form 62 may be used the entire height of the assembly 10. FIG. 19 shows a tie bar 102, which is similar to the wire form 62. The tie bar 102 includes ends 104 and a body 106. As shown in FIG. 19B, tie bar ends 104 are generally curved portions and the body 106 is generally flat. The tie bar 102 may be comprised of a cylindrical metal piece, such as a thick wire or other metal extrusion. The tie bar 102 may be welded or otherwise fixed to the interior side of the inner arms 24 or outer arms 26 to aid in the routing of a hose or cable 70. Similarly to the wire forms 62, the tie bar 102 may be fixed along the bodies of the arms from the lower end 16 to the upper end 18 of the assembly.

Figure 20:
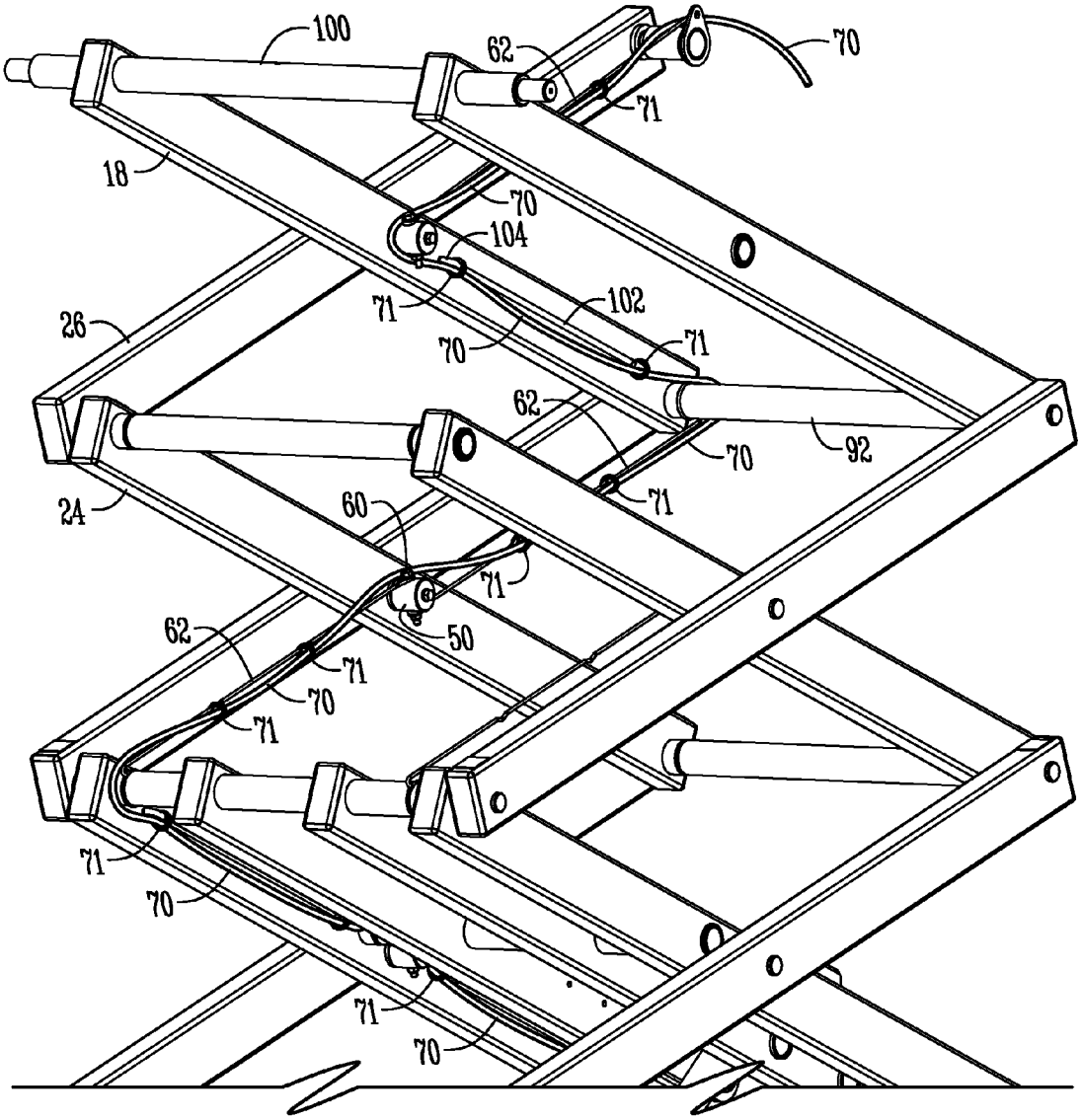
FIG. 20 is an enlarged perspective view of a portion of an extended scissor stack assembly showing a hose, cable, or wire being routed along the arms.

The use of the wire forms 62 or tie bars 102 to route a hose 70 is shown in FIG. 20, which is a partially enlarged view of the scissor stack assembly 10 with a hose 70 routed along the arms of the assembly. Starting at the lower end 16, a hose, cable, or wire 70 follows the inside of a first cylinder arm 76 and attaches to either tie bars 102 or wire form 62. The hose 70 is attached to the tie bar ends 104 or tie area 68 by use of zip ties, hose clamps, string, or other fixing means 71 sufficient to wrap around a hose and wire form or tie bar. When the hose 70 reaches an end of an arm, the cables or hoses 70 are routed around the crosstube and further up the next arm in an opposite manner of the first one. The wrapping of the hose 70 around the crosstube creates a natural flexing point for the hose or cable 70. The hose or cable 70 is continued up the assembly 10, attaching to wire form 62 or tie bars 102 until it reaches an upper end 18 of the assembly 10. It should be noted that at each end of an arm, the hose 70 should be wrapped around a crosstube 92 before being routed up the opposite way attached to the next arm. There may be any number of sections in the assembly 10 to create higher and higher lift height. However, is should be noted that if the hose or cable 70 needs to end at a particular side or end of the assembly 10, the hose 70 may be redirected at a cap 50 location of an inner arm 24 to be redirected in an opposite direction.

Other alternative variations obvious to those in the field of the art are considered to be included in this invention. For example, the size, shape, and material used for the inner arms, outer arms, wire forms, tie bars, crosstubes, and caps may be varied. In addition, the number of arms of the assembly may be varied to vary the height of the assembly itself. The description is merely an example of an embodiment and limitations of the invention are not limited to the application.

What is claimed is:

1. A scissor stack assembly, comprising: a plurality of inner and outer arms operably connected to each other so as to move the assembly between a collapsed position and a raised position; at least one wire form comprising a piece of wire having a loop at a first end which attaches to a cap and a hook at a second end, said wire form configured to aid in routing a hose; said outer arms being connected to the inner arms by a retaining pins extending inward from a central position of the outer arm along its length through an aperture in a central position of the inner arm along its length and retained with said cap positioned at an interior of each of the inner arms and covering a portion of the retaining pin extending through said inner arms; wherein the retaining pins are affixed to the outer arms such that the pins do not rotate relative to the outer arms; and wherein each retaining pin extends through one outer arm and one inner arm.

2. The assembly of claim 1 further comprising a cylinder operably connected to the plurality of inner and outer arms and configured to extend and retract so as to move the assembly between the collapsed position and the raised position.

3. The assembly of claim 1 further comprising a means for securing said cap to the retaining pin inserted through both the cap and retaining pin to retain the outer arm to the inner arm.

4. The assembly of claim 1 wherein the plurality of outer arms further comprises at least one connecting pin positioned at an end of the outer arm.

5. The assembly of claim 4 wherein the plurality of inner arms comprises at least one connecting aperture located at an end of the inner ansa for receiving the at least one connecting pin of the outer arm.

6. The assembly of claim 5 wherein the retaining pin and the at least one connecting pin comprise preplated steel.

7. A scissor stack assembly for raising a load between a collapsed position and a raised position, comprising: a right bottom arm comprising a tube with connecting pins extending inwardly proximate opposite ends of tube; and a retaining pin extending inward at a central location along the length of the tube; a left bottom arm comprising a tube with connecting pins extending inwardly proximate opposite ends of tube, and a retaining pin extending inward at a central location along the length of the tube; a first cylinder arm positioned between the right and left bottom arms, the first cylinder arm connected to the right and left bottom arms at the retaining pins of the arms; a plurality of right inner and outer arms operably connected to the right bottom arm, the plurality of right inner and outer arms retained to each other at retaining pins extending from and affixed to a central location along the length of each of the outer arms and through an aperture at a central location of each of the inner arms such that the pins do not rotate relative to the outer arms; a plurality of left inner and outer arms operably connected to the left bottom arm, the plurality of left inner and outer arms retained to each other at retaining pins extending from and non-rotationally affixed to a central location along the length of each of the said left outer arms and through, an aperture at a central location of each of the said left inner arms; at least one wire form comprising a piece of wire having a loop at a first end which attached to a cap and a hook at a second end, said wire form configured to aid in routing a hose; a second cylinder arm operably connected between the plurality of right inner and outer arms and the plurality of left inner and outer arms; and a cylinder positioned between the first and second cylinder arms; wherein each retaining pin extends through one outer arm and one inner arm.

8. The assembly of claim 7 wherein the first cylinder and second cylinder arm each comprises a plurality of inner tubes spaced apart from each other and connected by a plurality of crosstubes.

9. The assembly of claim 7 wherein the plurality of right outer arms comprise connecting pins extending inwardly and positioned proximate opposite ends of the right outer arms.

10. The assembly of claim 9 wherein the plurality of left outer arms comprise connecting pins extending inwardly and positioned proximate opposite ends of the arms.

11. The assembly of claim 10 wherein the right and left inner arms comprise through holes proximate opposite ends of said right and left inner arms.

12. The assembly of claim 11 further comprising a plurality of crosstubes connecting a right inner arm to a left inner arm, the crosstubes containing opposite ends positioned in the through holes of said right and left inner arms.

13. The assembly of claim 12 wherein the connecting pins of the plurality of right outer arms are configured to be inserted into apertures in the end of a crosstubes.

14. The assembly of claim 13 wherein the connecting pins of the plurality of left outer arms are configured to be inserted into apertures in an opposite end of the crosstubes.

15. The assembly of claim 10 wherein the connecting pins and retaining pins are welded to the plurality of left and right outer arms.

16. The assembly of claim 8 further comprising a plurality of wire forms extending from one of the plurality of crosstubes to a retaining pin along the length of one of the plurality of left or right outer arms.

17. The assembly of claim 16 wherein the plurality of wire forms comprise a piece of wire with a hook portion at one end for at least partially surrounding a portion of one of the plurality of crosstubes, a loop at the opposite end for connecting to a retaining pin, and a plurality of tie areas therebetween, wherein a cable is tied to the wire form at the tie areas.

18. The assembly of claim 7 wherein the right and left bottom arms, the plurality of right inner and outer arms, and the plurality of left inner and outer arms comprise a rectangular tube shape.

19. The assembly of claim 7 further comprising a plurality of caps placed over a portion of the retaining pins extending through the inner arms, and at least one bolt extending through the cap and retaining pin so as to retain an outer arm to an inner arm.

20. The assembly of claim 7 wherein the re ng pins comprise a preplated steel bar.

21. The assembly of claim 7 further comprising means for attaching the scissor stack assembly to a platform.

22. The assembly of claim 7 wherein the first and second cylinder arms further comprise a support member configured to operably connect the cylinder to the cylinder arms.

23. A method of routing a cable or hose from a lower end of a scissor stacking assembly to an upper end of the assembly, comprising:

providing a scissor stack assembly including a plurality of inner and outer arms connected to one another, a retainer pin extending from the outer arms through an aperture in the inner arms to retain the arms together, and a plurality of crosstubes extending from a right side of the assembly to a left side;

connecting a plurality of wire forms from one of the plurality of crosstubes to one of the plurality of retaining pins along an inside of an outer or inner arm from the lower end of the assembly to the upper end of the assembly; and attaching a cable or hose to the plurality of wire forms from the lower end of the assembly to the upper end of the assembly.

24. The method of 23 further comprising wrapping the cable or hose around each of the plurality of crosstubes to reverse the direction of the cable or hose.

25. The method of 24 wherein the cable or hose is attached to the plurality of wire from by tying the hose or cable to a portion of the plurality of wire forms.

26. A scissor stack assembly, comprising:

a right side comprising a plurality of outer arms including connecting pins extending from opposite ends of the arms and a retaining pin extending from a central location along the length of the arm, and a plurality of inner arms connected to the outer arms, the inner arms including connecting apertures at opposite ends of the arms and a retaining aperture at a central location along the length of the arm;

wherein the retaining pins are configured to be inserted through the retaining apertures and the connecting pins are configured to be inserted through the connecting apertures, said retaining pins being affixed to the outer arms such that the pins do not rotate relative to the outer arms;

a left side comprising a plurality of outer arms including connecting pins extending from opposite ends of the arms and a retaining pin extending from a central location along the length of the arm, and a plurality of inner arms connected to the outer arms, the inner arms including connecting apertures at opposite ends of said inner arms and a retaining aperture at a central location along the length of the arm;

wherein the retaining pins are configured to be inserted through the retaining apertures and the connecting pins are configured to be inserted through the connecting apertures;

a plurality of retaining caps covering a portion of the retaining pins to hold the inner and outer arms together;

means for securing the caps to the retaining pins, inserted through both the cap and retaining pin;

a plurality of crosstubes extending from the plurality of connecting pins of the right side to the plurality of connecting pins on the left side;

a cylinder operably connected to the right and left sides to extend and retract the assembly between a collapsed position and a raised position; and a plurality of wire forms attached to the plurality of crosstubes and caps configured to aid in the routing of a hose.

27. The assembly of claim 26 wherein each of the plurality of wire forms extends from one of crosstubes to one of the plurality of retaining pins along an arm.

28. The assembly of claim 27 further comprising a cable extending the height of the assembly, the cable attached to the plurality of wire forms along the lengths of the arms to route the cable from a lower end of the assembly to an upper end of the assembly.

29. The assembly of claim 26 wherein the plurality of connecting pins are configured to insert into recesses in the ends of the plurality of crosstubes such that each of the arms are able to rotate in relation to the crosstubes.

30. The assembly of claim 26 further comprising first and second cylinder arms positioned between the right and left side, the first cylinder arm configured to be attached to a first end of the cylinder and the second cylinder arm configured to be attached to a second end of the cylinder.

31. The assembly of claim 26 wherein the plurality of right and left inner arms and the plurality of right and left outer arms comprise a rectangular tube shape.

32. The assembly of claim 26 further comprising a hose routed from a lower end of the assembly to an upper end, said hose routed along the plurality of inner arms and connected to the plurality of wire forms.

33. The assembly of claim 26 further comprising a plurality of tie bars attached to the plurality of left or right inner arms to aid in the routing of a hose.

34. The assembly of claim 26 wherein each of the plurality of wire forms comprises a hook end and a loop end.

* * * * *

UNITED STATES PATENT AND TRADEMARK OFFICE

CERTIFICATE OF CORRECTION

PATENT NO. : 8,919,735 B2
APPLICATION NO. : 13/034178
DATED : December 30, 2014
INVENTOR(S) : Darin Michael Rosenboom et al.

It is certified that error appears in the above-identified patent and that said Letters Patent is hereby corrected as shown below:

In the Claims

Col. 11, Claim 5, Line 30:
DELETE after inner "ansa"
ADD after inner --arm--

Col. 12, Claim 20, Line 46:
DELETE after wherein the "re ng"
ADD after wherein the --retaining--

Signed and Sealed this
Fourteenth Day of April, 2015

Michelle K. Lee

Michelle K. Lee
*Director of the United States Patent and Trademark Office*